US006224524B1

(12) United States Patent
Singh

(10) Patent No.: US 6,224,524 B1
(45) Date of Patent: May 1, 2001

(54) EXERCISE GRIPS ATTACHED TO SHOES

(75) Inventor: Philip Ignatius Singh, Falls Church, VA (US)

(73) Assignee: All Starts, Inc., Falls Church, VA (US)

( * ) Notice: Subject to any disclaimer, the term of this patent is extended or adjusted under 35 U.S.C. 154(b) by 0 days.

(21) Appl. No.: 09/330,980

(22) Filed: Jun. 14, 1999

(51) Int. Cl.[7] ..... A63B 22/14

(52) U.S. Cl. ..... 482/148; 482/79; 482/907; 36/45; 36/136

(58) Field of Search ..... 482/148, 907, 482/75, 79; 2/978, 245; 223/113; 24/712, 68 SK; 36/45, 136

(56) References Cited

U.S. PATENT DOCUMENTS

| | | |
|---|---|---|
| 599,341 | 2/1898 | Meeteer . |
| 1,640,669 | 8/1927 | Sankey . |
| 2,393,810 | 1/1946 | Purinton . |
| 2,804,700 | 9/1957 | Holtkamp et al. . |
| 3,175,292 | 3/1965 | MacQuaid et al. . |
| 4,069,599 | 1/1978 | Alegria . |
| 4,333,248 | 6/1982 | Samuels . |
| 4,596,387 | 6/1986 | Roberts . |
| 5,272,822 | 12/1993 | Diaz . |
| 5,701,688 | 12/1997 | Crowley . |

FOREIGN PATENT DOCUMENTS

| | | |
|---|---|---|
| 97 | of 1914 | (GB) . |
| 830 913 | 2/1952 | (DE) . |

*Primary Examiner*—Jerome W. Donnelly
*Assistant Examiner*—Lori Baker Amerson
(74) *Attorney, Agent, or Firm*—Stephen Christopher Swift; Swift Law Office

(57) ABSTRACT

A shoe, preferably an athletic shoe, with an attachment designed to give people who have just begun an exercise program, and have not yet achieved sufficient flexibility to be able to comfortably touch their toes, something to grab onto that is attached to the toes of their shoes. The attachment consists of two side members that go on each side of the shoe from the toe to the opening for the leg, and a front piece and several cross-pieces connecting the side members, like rungs on a ladder. The side members, front piece and cross-pieces can be sewn together, or cut from one piece of material. The front piece is sewn to the toe of the shoe or otherwise permanently attached. A person using the invention may begin by reaching the cross-piece furthest from the toe, and work his or her way downward, one rung at a time, until they are able to touch their toes. The side members may be removably attached to the shoe by strips of hook and loop fasteners, when the attachment is not in use. The attachment may also be secured against the shoe by a strap passing over it. The strap is permanently attached to one side of the shoe, and removably attached to the other side of the shoe by hook and loop fasteners. The attachment should be made of a strong, but flexible material, that will not absorb moisture (such as perspiration caused by exercise).

14 Claims, 6 Drawing Sheets

EXERCISE GRIPS ATTACHED TO SHOES

BACKGROUND OF THE INVENTION

1. Field of the Invention

The present invention relates to exercise devices attached to shoes.

2. Description of the Prior Art

Toe touching is an important form of calisthenics, that helps to develop and maintain flexibility, especially in the hips, hamstring muscles, calf muscles, abdominal muscles and lower back. People who have not made a habit of regular physical exercise, and as a result have gotten out of shape and lost flexibility, often have trouble reaching their toes. If they try too hard, they may strain themselves, and/or become discouraged and give up. The present invention comprises shoes, preferably athletic shoes, with ladder-like handles that are attached to the shoes. An exerciser may begin by at first bending over and holding only the top "rung", and then work his or her way down the "ladder", one "rung" at a time, as he or she develops greater flexibility, until they can touch their toes. While there are numerous previous inventions for attachments to shoes, none are equivalent to the present invention.

U.S. Pat. No. 599,341, issued on Feb. 22, 1898, to James H. Meeteer, discloses a foot covering, designed to fit over a shoe, which has longitudinal and transverse strips. The instant invention is distinguishable, in that it is permanently attached to the toe of the shoe, and has vacant spaces between the strips.

U.S. Pat. No. 1,640,669, issued on Aug. 30, 1927, to Clinton E. Sankey, discloses a foot protector, designed to protect the feet of workers from falling objects, with a plurality of reinforcing ribs. The instant invention is distinguishable, in that it is permanently attached to the toe of the shoe, and has vacant spaces between the ribs.

U.S. Pat. No. 2,393,810, issued on Jan. 29, 1946, to William A. Purinton, discloses an instep guard and a shoe including the instep guard, having guard members going across the instep, connected by a cross member. The instant invention is distinguishable, in that most of it is detachable from the shoe, and it is made of a flexible material.

U.S. Pat. No. 2,804,700, issued on Sep. 3, 1957, to Norman C. Holtkamp and Jules J. Oppenheim, discloses a protective foot guard, having a latticework of rods, which may go over the front part of a shoe. The instant invention is distinguishable, in that it is made of a flexible material, and is permanently attached to the toe of the shoe.

U.S. Pat. No. 3,175,292, issued on Mar. 30, 1965, to Craig MacQuaid et al., discloses a protective shoe construction, having a guard that fits over the laces of the shoe. The instant invention is distinguishable, in that it has open spaces between its cross-pieces.

U.S. Pat. No. 4,069,599, issued on Jan. 24, 1978, to Richard S. Alegria, discloses a shoe protector, designed for a drummer playing a trap set, having a flexible member that is attached to the toe of the shoe, and is held in place by a strap. The instant invention is distinguishable, in that it has open spaces between its cross-pieces.

U.S. Pat. No. 4,333,248, issued on Jun. 8, 1982, to Samuel Samuels, discloses a protective shoe, which may be an athletic shoe, having a flexible sheet that covers the front part of the shoe, and may be permanently attached at the toe. The instant invention is distinguishable, in that it has open spaces between its cross-pieces.

U.S. Pat. No. 4,596,387, issued on Jun. 24, 1986, to Patrick S. Roberts, discloses exercise handles for athletic shoes, which can be grasped by the person wearing the shoes, to aid and augment exercises. The exercise handles are removably attached by the use of hook and loop fasteners, snaps, or other means. The invention is distinguishable, in that it is formed from a pair of side members and a plurality of cross-pieces, all of which are joined together in one piece that is permanently attached to the toe of the shoe.

U.S. Pat. No. 5,272,822, issued on Dec. 28, 1993, to Vincent Diaz, discloses a protective cover for shoes, boots and the like, that is a flexible unitary member, permanently attached at the toe portion, but partially removable. The instant invention is distinguishable, in that it does not completely cover the front of the shoe, and has side and cross-pieces rather than a single unitary member.

U.S. Pat. No. 5,701,688, issued on Dec. 30, 1997, to Kevin J. Crowley, discloses a protective shoelace cover, that can be detachably secured to a shoes upper by hook and loop fasteners or other means, and has a window through which the shoelaces can be seen. The instant invention is distinguishable, in that it is permanently attached at the toe, and has open spaces between its cross-pieces.

British Patent No. 97, complete specification accepted on Sep. 3, 1914, to George Rudder and John Lewis Jones, discloses improvements in foot and shin guards for workmen, comprised of metal strips that cover the front of the shoe. The instant invention is distinguishable, in that it is made of a flexible material, and has cross-pieces.

West German Patent No. 830 913, issued on Feb. 7, 1952, to Erich Lilge, discloses a protective device that can be strapped over the toe of a shoe. The instant invention is distinguishable, in that it is permanently attached to the toe, and has flexible side members and cross-pieces extending from the toe.

None of the above inventions and patents, taken either singly or in combination, is seen to describe the instant invention as claimed.

SUMMARY OF THE INVENTION

The present invention is a shoe (preferably an athletic shoe) with an attachment designed to give people who have just begun an exercise program, and have not yet achieved sufficient flexibility to be able to comfortably touch their toes, something to grab onto that is attached to the toes of their shoes. The attachment should be made of a strong, but flexible material, that will not absorb moisture (such as rain, perspiration, or moisture from the ground or running surface). It consists of two side members that go on each side of the shoe from the toe to the opening for the leg, and a front piece and several cross-pieces connecting the side members, like rungs on a ladder. The side members, front piece and cross-pieces can be sewn together, or cut from one piece of material. The front piece is sewn to the toe of the shoe or otherwise permanently attached. The side members may be removably attached to the shoe by strips of hook and loop material ("VELCRO"), when the attachment is not in use. The attachment may also be secured against the shoe by a strap passing over it (which may also be secured to the body of the shoe by hook and loop material) when it is not in use.

A person using the invention may begin by reaching the cross-piece furthest from the toe, and work his or her way downward, one "rung" at a time, until they are able to touch their toes. A person in a seated position with legs straddled could grab the first rung of the invention on either foot with the corresponding hand, working their way down while stretching the hamstring, upper and lower back and calf muscles. While in a seated position with one leg extended straight from the mid section, with the sole of the other foot against the inner thigh of the extended leg, a user can grab the first rung of the invention with either hand, and work their way down, stretching the hamstring, upper and lower back and calf muscles. In a standing position with legs straddled, a user can grab the first rung of the invention on either foot with either hand, and work their way down, stretching hamstrings, upper and lower back, side, inner thigh, groin, and calf muscles.

Accordingly, it is a principal object of the invention to provide a new aid to physical exercise.

It is another object of the invention to encourage users to incorporate stretching as part of exercise, leading to greater flexibility by promoting proper stretching techniques, while inhibiting bouncing which can lead to muscle strain and injury.

It is a further object of the invention to provide a new combination of an athletic shoe with a physical exercise device.

Still another object of the invention is to provide a method of physical exercise using attachments to athletic shoes.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention is a shoe (or pair of shoes), preferably an athletic shoe or "sneaker", with an attachment that I call the "sneaker stretch". It is designed to give people who have just begun an exercise program, and have not yet achieved sufficient flexibility to be able to comfortably touch their toes, something to grab onto that is attached to the toes of their shoes.

Figure 1:
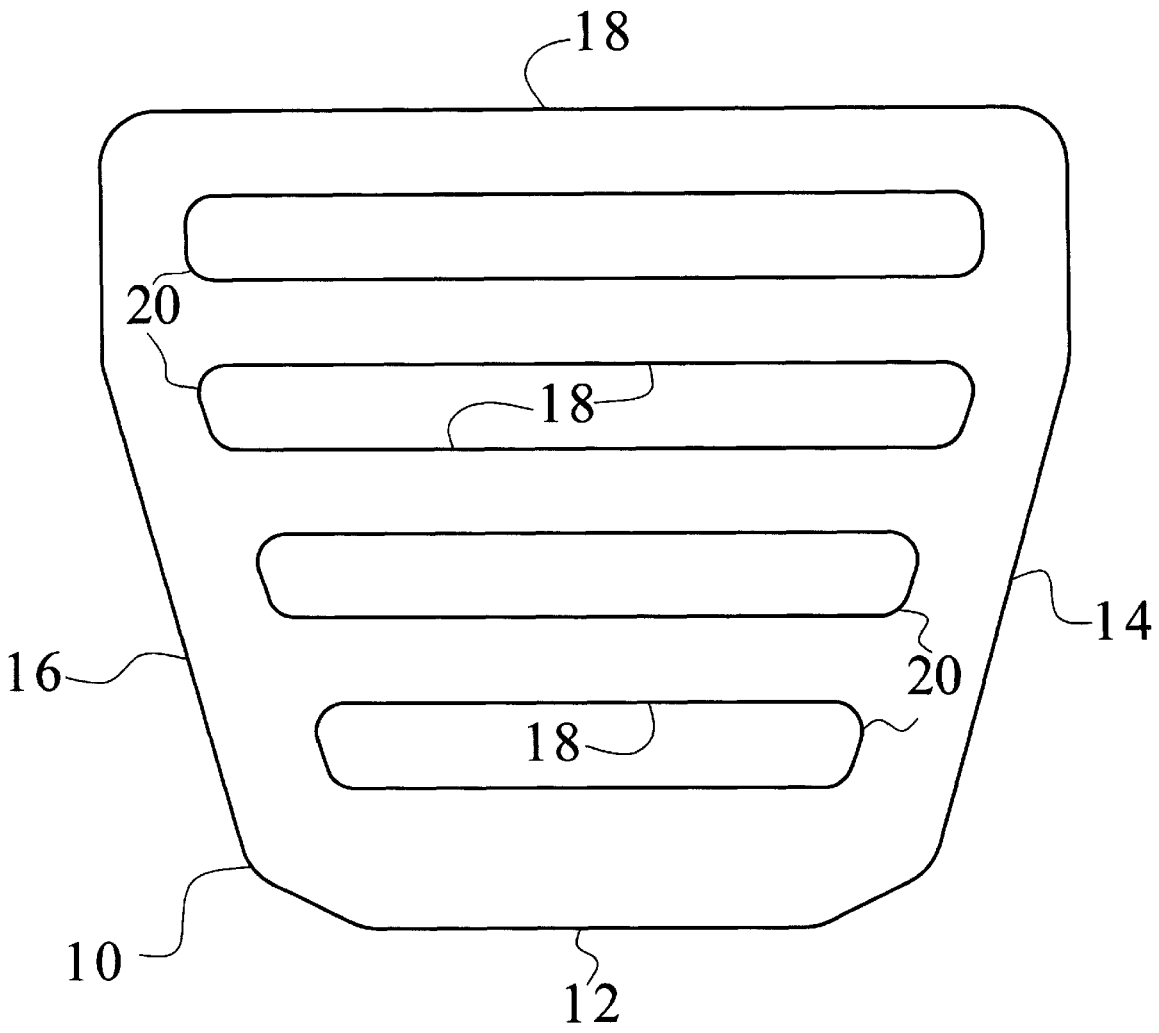
FIG. 1 is a front elevational view of the attachment to the shoe.

FIG. 1 is a front elevational view of the attachment 10 to the shoe. It includes a front piece 12 that is sewn to the toe of the shoe or otherwise permanently attached, a left side member 14 attached to the left side of the front piece, a right side member 16 attached to the right side of the front piece, and one or more (preferably several) cross-pieces 18 connecting the side members, like rungs on a ladder. (Please note that left and right are with reference to the shoe and the user, not with reference to the drawing.) The front piece, side members and cross-pieces can be made from separate pieces of material that are sewn together. Alternatively, the attachment can be made from one piece of material, with the openings 20 between the front piece, side members and cross-pieces cut out. A person using the invention may begin by reaching the cross-piece furthest from the toe, and work his or her way downward, one rung at a time, until they are able to touch their toes. The attachment should be made of a strong, but flexible material, that will not absorb moisture (such as perspiration caused by exercise).

Figure 2:
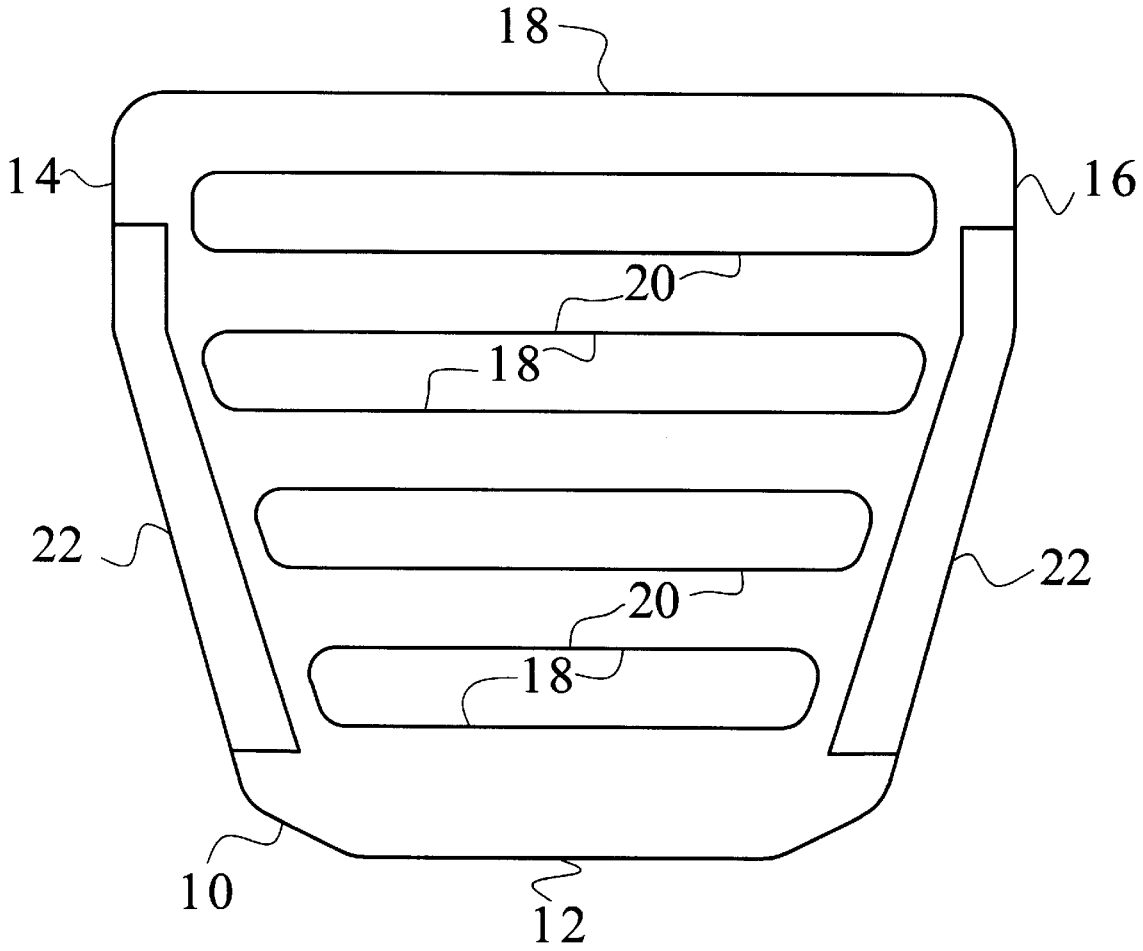
FIG. 2 is a rear elevational view of the attachment to the shoe.

FIG. 2 is a rear elevational view of the attachment to the shoe, showing strips of hook and loop fasteners 22 (commonly referred to by the trademark "VELCRO") that can engage strips of hook and loop material on the shoe, to removably retain the attachment against the shoe when the attachment is not being used for exercise.

Figure 3:
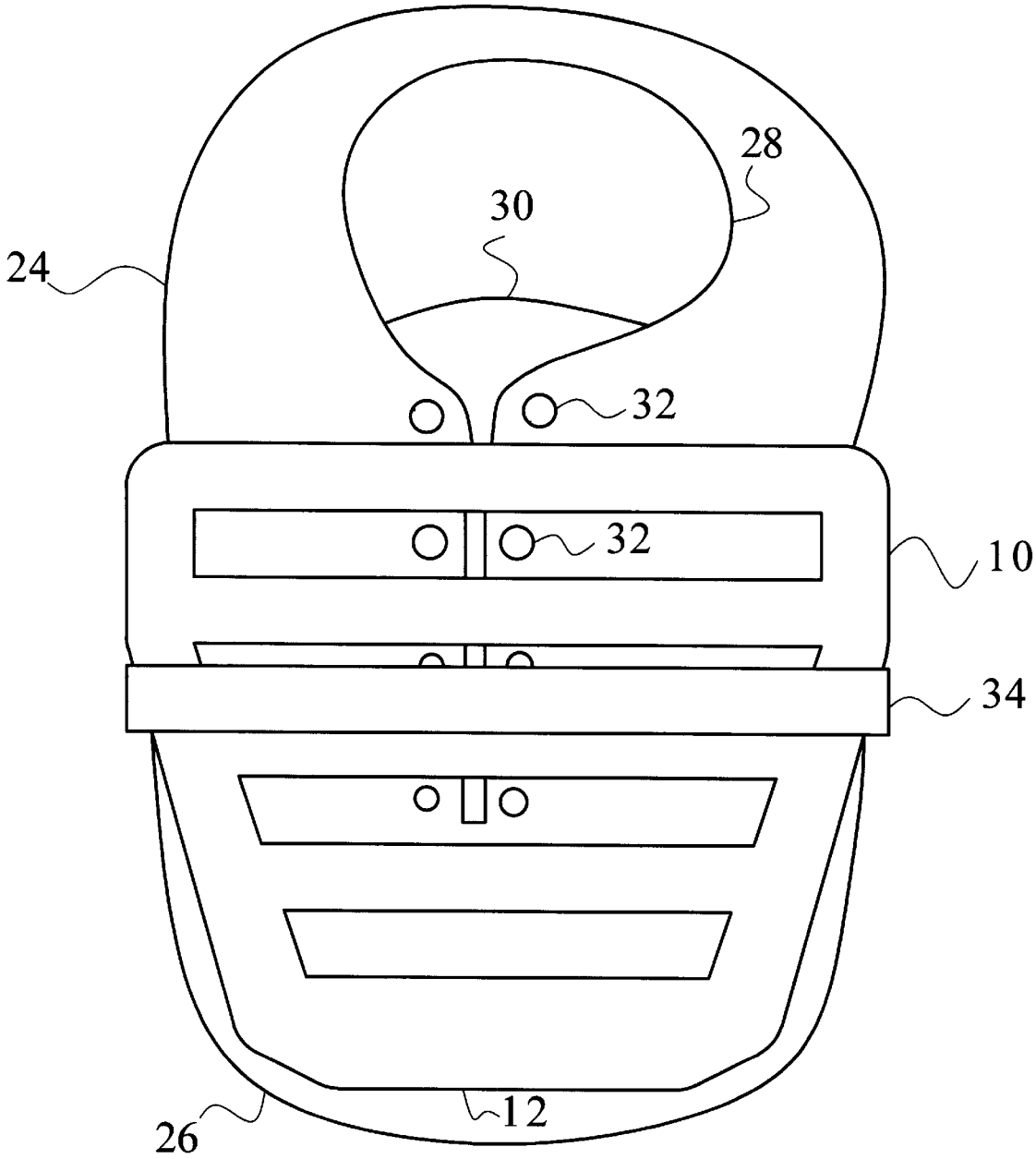
FIG. 3 is a top view of the right shoe with the attachment in a lowered position.

FIG. 3 is a top view of the right shoe 24 (the left shoe of the pair of shoes being a mirror image of the right shoe) with the attachment 10 in the lowered position in which it will normally be retained when not being used for exercise, showing the toe 26 to which the front piece 12 is permanently attached, the opening for the user's leg 28, the tongue 30, and eyelets 32 through which shoelaces (omitted for clarity in this figure) are inserted. In the lowered position the attachment should preferably come back almost to the opening for the user's leg. The attachment is further secured against the shoe by the strap 34.

Figure 4:
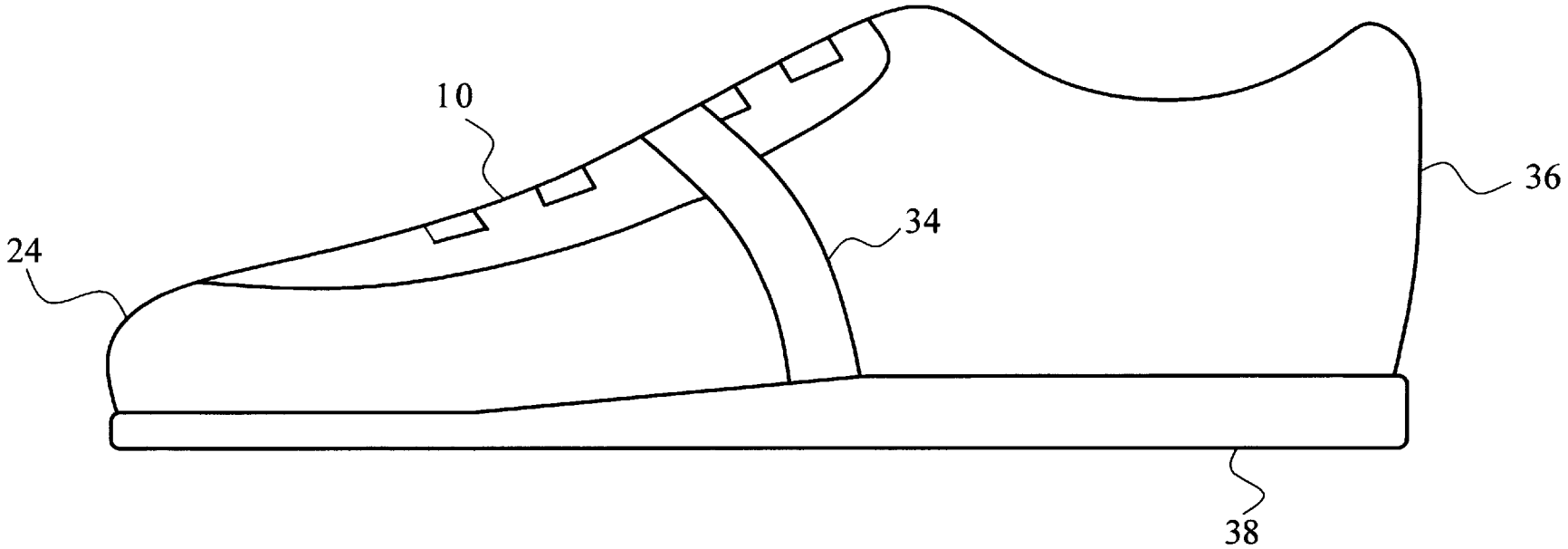
FIG. 4 is a left side elevational view of the right shoe with the attachment in a lowered position.

FIG. 4 is a left side elevational view of the right shoe 24 with the attachment 10 in a lowered position. The strap 34 is permanently attached to one side the shoe, by sewing or other means, preferably where the shoe's upper 36 is joined to the shoe's sole 38, and removably attached to the other side of the shoe, preferably by hook and loop fasteners.

Figure 5:
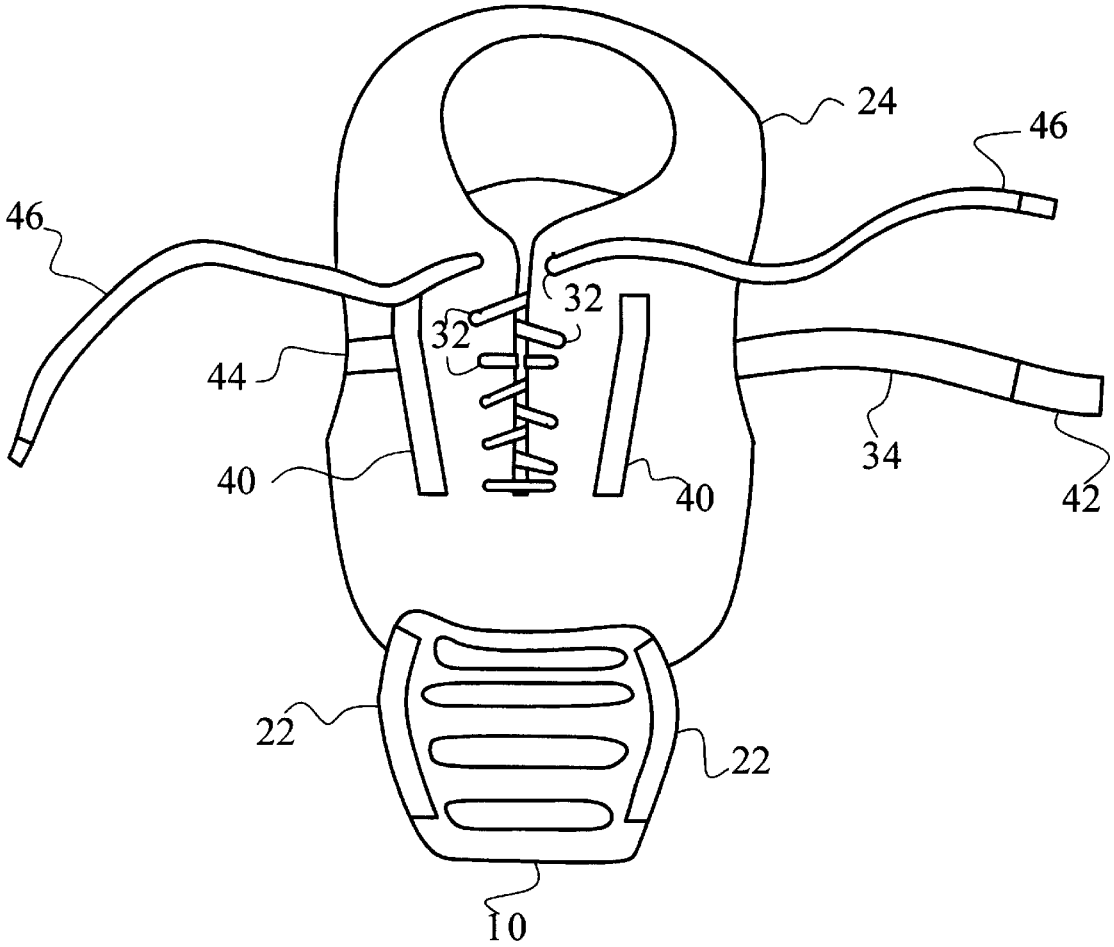
FIG. 5 is a top view of the right shoe with the attachment in a raised position.

FIG. 5 is a top view of the right shoe 24 with the attachment 10 in a raised position, as when the attachment is being used for exercise, showing the strips of hook and loop fasteners 40 on the shoe that engage strips of hook and loop fasteners 22 on the attachment, a strip of hook and loop fasteners 42 on the strap 34 that engages a strip of hook and loop fasteners 44 on the shoe, and a shoelace 46 inserted through eyelets 32.

Figure 6:
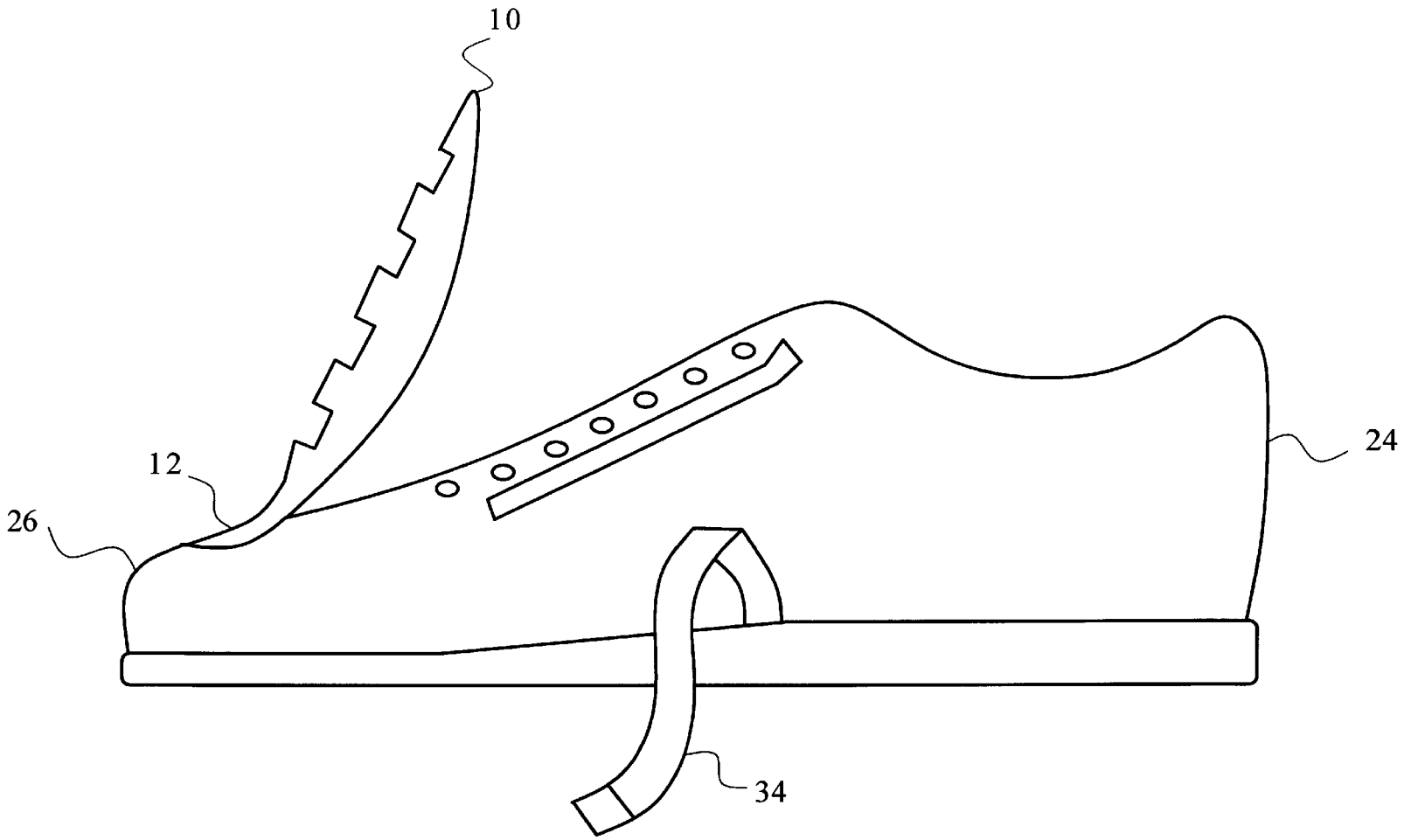
FIG. 6 is a left side elevational view of the right shoe with the attachment in a raised position.

FIG. 6 is a left side elevational view of the right shoe 24 with the attachment 10 in a raised position and the strap 34 detached on from the right side of the shoe and removed from over the attachment, showing that the front piece 12 of the attachment remains attached to the toe 26 of the shoe.

It is to be understood that the present invention is not limited to the sole embodiment described above, but encompasses any and all embodiments within the scope of the following claims.

I claim:

1. A shoe with an attachment, comprising:

a shoe having a toe; and an attachment made of a flexible material having a front portion attached to the toe of the shoe, a left side member attached to a left side of the front portion, a right side member attached to a right side of the front portion, and cross-pieces between the left side member and the right side member, each cross-piece being attached to both the left side member and the right side member, with adjacent cross-pieces being separated by spaces passing from left to right between the left side member and the right side member, wherein the attachment can be moved from a lowered position, in which the side members and the cross-pieces rest on the shoe, to a raised position, in which the side members and cross-pieces are elevated above the shoe.

2. The shoe with an attachment according to claim 1, wherein in the lowered position, hook and loop fasteners on a lower side of the attachment engage hook and loop fasteners on an upper side of the shoe, thereby removably retaining the side members and the cross-pieces on the shoe.

3. The shoe with an attachment according to claim 1, wherein the attachment is made of a material that does not absorb water.

4. The shoe with an attachment according to claim 1, wherein the front portion, side members and cross-pieces of the attachment are made from separate pieces of material, and the separate pieces are joined together.

5. The shoe with an attachment according to claim 4, wherein the separate pieces are sewn together.

6. The shoe with an attachment according to claim 1, wherein the attachment is made from a single piece of material, and spaces between the front portion, side members and cross-pieces are cut out.

7. The shoe with an attachment according to claim 1, wherein the shoe has an upper made of a flexible material, and a sole made of an elastic material.

8. A pair of shoes with attachments, comprising:

a pair of shoes, each shoe having a toe; and an attachment made of a flexible material having a front portion attached to the toe of the shoe, a left side member attached to a left side of the front portion, a right side member attached to a right side of the front portion, and cross-pieces between the left side member and the right side member, each cross-piece being attached to both the left side member and the right side member, with adjacent cross-pieces being separated by spaces passing from left to right between the left side member and the right side member, wherein the attachment can be moved from a lowered position, in which the side members and the cross-pieces rest on the shoe, to a raised position, in which the side members and cross-pieces are elevated above the shoe.

9. The pair of shoes with attachments according to claim 8, wherein in the lowered position, hook and loop material on lower sides of the attachments engages hook and loop material on upper sides of the shoes, thereby removably retaining the side members and the cross-pieces on the shoes.

10. The pair of shoes with attachments according to claim 8, wherein the attachments are made of a material that does not absorb water.

11. The pair of shoes with attachments according to claim 8, wherein the front portion, side members and cross-pieces of the attachments are made from separate pieces of material, and the separate pieces are joined together in each attachment.

12. The pair of shoes with attachments according to claim 11, wherein the separate pieces are sewn together.

13. The pair of shoes with attachments according to claim 11, wherein the attachments are each made from a single piece of material, and spaces between the front portion, side members and cross-pieces are cut out.

14. The pair of shoes with attachments according to claim 11, wherein each shoe has an upper made of a flexible material, and a sole made of an elastic material.

* * * * *